United States Patent [19]

Brochand

[11] Patent Number: 4,898,100

[45] Date of Patent: Feb. 6, 1990

[54] AERIAL TRANSPORT INSTALLATION WITH TWO SUSPENSION-TRACTION CABLES AND PULLEYS DISPLACED VERTICALLY

[75] Inventor: Max Brochand, Noyarey, France

[73] Assignee: Pomagalski SA, Fontaine, France

[21] Appl. No.: 166,202

[22] Filed: Mar. 10, 1988

[30] Foreign Application Priority Data

Mar. 11, 1987 [FR] France ..... 87 03330

[51] Int. Cl.[4] ..... B61B 7/00

[52] U.S. Cl. ..... 104/192; 104/28; 104/91

[58] Field of Search ..... 104/27, 28, 89, 91, 104/96, 173.1, 173.2, 180, 189, 191, 192

[56] References Cited

U.S. PATENT DOCUMENTS

| | | | |
|---|---|---|---|
| 472,211 | 4/1892 | Fralinger | 104/173.1 |
| 586,901 | 7/1897 | Hunter | 104/192 |
| 4,509,430 | 4/1985 | Creissels | 104/180 X |
| 4,712,486 | 12/1987 | Tarassoff | 104/173.1 |
| 4,741,272 | 5/1988 | Tarassoff | 104/173.1 |

FOREIGN PATENT DOCUMENTS

| | | | |
|---|---|---|---|
| 108924 | 2/1928 | Austria | 104/173.1 |
| 558357 | 8/1932 | Fed. Rep. of Germany | 104/192 |

*Primary Examiner*—Margaret A. Focarino
*Assistant Examiner*—Joseph A. Pape
*Attorney, Agent, or Firm*—Fred A. Keire

[57] ABSTRACT

An aerial transport installation having two parallel continuously moving suspension traction cables defining two endless loops have at least one cable car equipped with ward rippers for clamping the cables on the top part of the cables. The cables define a line of circulation for the cars including a track of arrival and a track of departure at each station, with the tracks defining horizontal planes. The end pulleys at each station include at least one return pulley for separating the cable loops so that the cable car can be totally disengaged and disassociated from the cable. The pulleys are arranged such that a longitudinal free space is provided between the loops of the cable at each station to facilitate the removal of the cable car from the cables.

19 Claims, 6 Drawing Sheets

AERIAL TRANSPORT INSTALLATION WITH TWO SUSPENSION-TRACTION CABLES AND PULLEYS DISPLACED VERTICALLY

The invention relates to an aerial transport installation with two suspension and traction cables.

A transport installation with aerial cables is known per se to a person having ordinary skill in the art. Consequently the description refers specifically only to the elements and components which play a particular role in the invention. On the other hand the other elements or components (in particular the cars) are not described, knowledge thereof being implicit.

Transport installations with aerial cables of the type comprising one or several cars, each of these cars being connected rigidly but disconnectably to two endless suspension and traction cables, parallel to one another, located alongside one another in the horizontal direction, driven along and supported by intermediate pylons, are already known. The cables define, between two embarking/disembarking stations, two tracks for the circulation of cars. Persons or goods are taken on by the cars in these embarking/disembarking stations.

Installations with two suspension and traction cables of this kind (each of the cables being both suspension and traction cables) have numerous advantages, in particular a high frequency and increased capacity of the cars (and hence a greater flow of passengers or material) and an improved lateral stability of the cars (resistance to wind). The fact that the cars are connected to the cables in a disconnectable manner makes it possible to disengage the vehicles from between the cables in the embarking/disembarking stations, so as to reduce their speed without altering that of the cables, or even to stockpile them in the station and then to re-engage them between the cables if necessary. It is also easy to modify the number of vehicles in line, according to need.

The problems posed by known installations of this kind result from the presence of the two cables combined with the desire to be able to engage/disengage the cars suspended from the cables.

The French Pat. No. 1,249,949 describes an installation wherein the cars are connected to the cables by means of grippers, gripping the underneath of the cables. They are naturally uncoupled therefore by opening the grippers, and the cars are deflected from the cables simply by moving down. An installation of this kind is fictitious, since the safety of the connection of the cars to the cables is not guaranteed, as the weight tends to open the grippers and to cause inopportune uncoupling.

The French Pat. No. 2,525,981 and the European Pat. No. 093 680 (the disclosures of which are incorporated herein by reference) describe an installation wherein the grippers are, in a classical manner, more secure, bearing on the top face of the cables. To prevent the vehicle from remaining trapped between the cables after the grippers are opened, guiding rollers are provided for the cables, which modify the space between these cables to allow disengaging of the car and its circulation on transfer rails independent of the cables. This solution is not satisfactory either. In fact the cables which are suspension and traction cables are of large diameter and very taut. Consequently, to install cable deflection rollers to modify the space between the cables is not only technically extremely complicated but also poses problems of safety, as the cables are then subjected to inadequately monitored stresses and may all the more readily escape from the rollers. This must in any event be avoided in the embarking/disembarking stations. Moreover the risks of derailment are proportionate to the number of deflecting rollers of an installation.

The unpublished American patent application Ser. No. 07/103893 of 1.10.87 already states that it is possible to displace two end pulleys cooperating respectively with each cable to disengage the cars. However this longitudinal displacement increases the congestion in stations too much.

Moreover the embarking/disembarking stations of these known installations are too voluminous and require groundspace which is not always available, particularly on mountains. The distance between the arrival and departure tracks in a station is limited, and subject to the diameter of the end pulleys. It is also desirable in certain cases (for example mountainous conditions at the station locations) for the arrival track not to be on the same plane as the departure track in a station. Finally the end pulleys of the two cable loops should be as close to one another as possible, to simplify the tension and driving mechanisms which constitute essential elements in two-cable suspension and traction installations. None of the known installations are able to satisfy these requirements.

The invention aims to solve the aforementioned problems in the known installations, and its object is an aerial transport installation wherein the distance between the cables remains constant along the line and relatively small (i.e. less than the transverse clearance of the cars, classically between 0.5 m and 3 m, in particular 0.75 m and 1.4 m); the grippers bear on the top part of the cables; the cars may simply be disengaged from the cables in the end stations, without this affecting the reliability of the installation (the risks of derailment being reduced to the minimum) or increasing the cost.

Further objects of the invention are also to reduce the congestion and the volume of an embarking/disembarking station of an installation of this kind; to allow the distance between the tracks to be selected as desired, in particular distances larger than those of the known installations; to allow tracks of arrival and departure in a station which are not on the same plane; and to make it possible to move the end pulleys of the two cable loops closer together.

The invention thus proposes an aerial transport installation with two suspension-traction cables, comprising in the first instance two suspension-traction cables which are substantially parallel, move continuously and form two endless loops passing over end driving, guiding, return or tensioning pulleys located in end embarking/disembarking stations, in the second place at least one and generally several cars equipped with disconnectable grippers for clamping the cables, in the third place means of disconnecting and connecting the grippers and means of supporting/guiding the cars located in embarking/disembarking stations, such that in line, the cars are engaged between, driven and conveyed by the cables, and that in the embarking/disembarking stations the cars are completely disengaged and dissociated from the cables, characterised in that in at least one embarking/disembarking station, for the track of arrival and for the track of departure defined by the cables, the respective zones of cooperation of a cable with the end pulleys in the tracks of arrival/departure are displaced longitudinally in relation to the zones of cooperation of the other cable with the end pulleys such that a longitudinal free space is provided between the respective sections of the farthest cable loops in relation to the station, in that at least one return pulley of at least one loop formed by a cable is recessed towards the inside of the car circulation line, guide means causing a half-turn of the cable upstream and downstream of the return pulley, in that at least one return pulley of at least one loop formed by a cable is substantially parallel to the track of arrival and/or to the track of departure, whilst being in a different plane.

According to the invention at least one return pulley of at least one loop formed by a cable, located in the farthest position in relation to this loop and separating the tracks of arrival and departure of the cable, is of a diameter different from—in particular smaller than—the lateral distance separating the track of arrival and the track of departure. The guiding pulleys towards a return pulley have inclined axes.

In an installation according to the invention, the distance between the two cables is keep constant upstream and downstream of the end pulleys, and no roller deflecting the cables so as to modify the distance between them is located at the entrance, exit or between the end pulleys. The safety of transport is thus considerably increased compared with the prior art. The disengagement/engagement of the cars from/between the cables is effected in a simple and secure manner, no special device being required on the cars or the carriages. It is also possible to disengage and engage upwards or downwards.

Moreover the size of the stations may be reduced, and their appearance and integration in the landscape may be improved; stations may be installed almost anywhere, whatever the relief, and the two cables may be tensioned and driven synchronously both simply and economically by means of known devices to this end.

Other characteristics and advantages of the invention will become clear from reading the following description of preferred embodiments thereof, with reference to the attached figures wherein.

Figure 1:
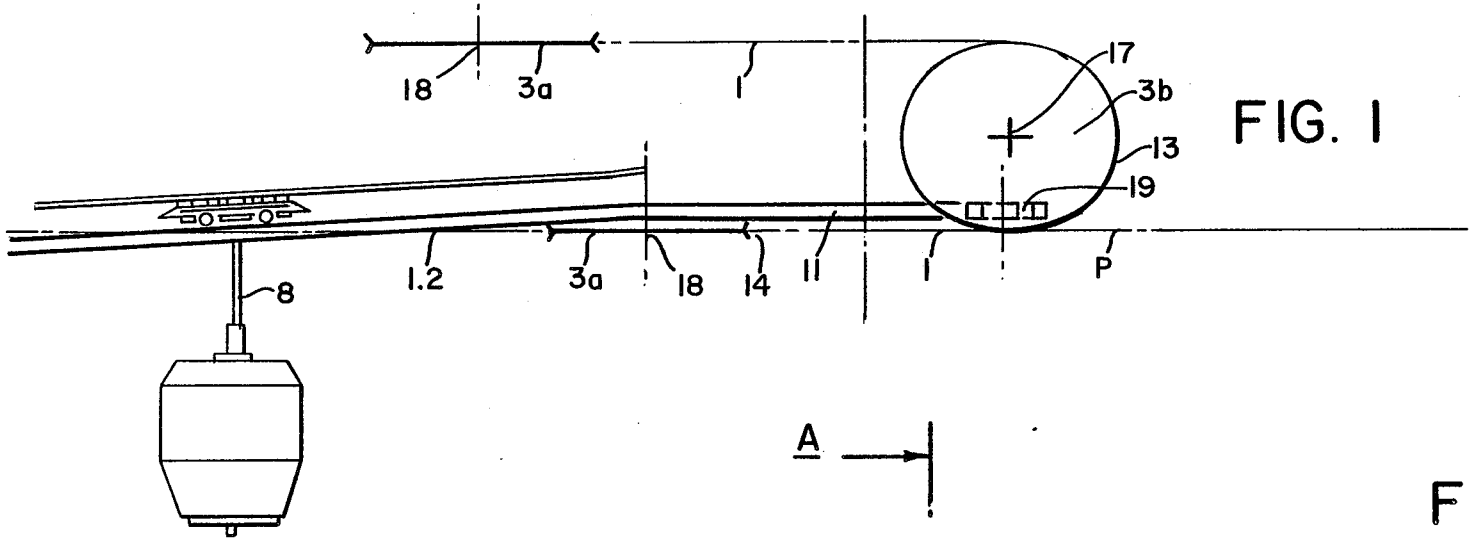
FIG. 1 is a side elevational view of an embarking-/disembarking station for an aerial transport installation according to a first embodiment of the present invention.

The invention relates to a transport installation with two aerial suspension and traction cables 1, 2, substantially parallel, driven in continuous motion in the same direction and forming two endless loops passing over end pulleys 3 located in embarking/disembarking stations. In at least one of the embarking/disembarking stations the pulleys 3 are pulleys for driving the cables 1, 2. In at least one of the embarking/disembarking stations the pulleys 3 are pulleys for returning or tensioning the cables 1, 2. "End" pulley 3 hereunder will be used to denote any pulley 3*a*, 3*b* for driving, guiding, return or tensioning a cable 1,2 located close to/or forming an end of a loop of cable 1,2. The cables 1, 2 define two circulation tracks which, in each embarking-/disembarking station, may be defined as a track of arrival 4 and a track of departure 5 with respect to the direction of movement of the cables 1, 2.

In the second place the installation comprises at least one, and generally several cars equipped with disconnectable grippers for clamping the cables 1,2. Generally speaking each car is conveyed by a carriage 7 (as disclosed for example in U.S. Pat. Nos. 4,509,430 and 4,741,272) comprising the disconnectable grippers, for example by way of an articulated suspending rod 8. The carriage, grippers and suspending rod are of generally known and conventional construction as described in the two aforementioned U.S. Patents and as also described in European Pat. No. 093680, which corresponds generally to U.S. Pat. No. 4,509,430. As these elements are known in the art, they are not described herein in detail, and are simply shown schematically in the drawings.

In the third place the installation comprises means of disconnecting and connecting the grippers 6, and means 11 for supporting/guiding cars and/or carriages located in the embarking/disembarking stations, so that in line the cars are engaged between, driven and conveyed by the cables 1, 2 and so that in the embarking/disembarking stations the cars are completely disengaged and dissociated from the cables 1,2.

The two cables 1, 2 defining each circulation track 4, 5 are at least substantially parallel and define, at least locally (between two intermediate pylons and in the stations, at least for each circulation track), a shared plane P of movement. This plane P is known as the "cable plane". The "horizontal" direction means any direction contained in this plane P, although in practice the plane P of the cables 1, 2 may be inclined when the cables move between a high station and a low station. The "vertical" direction is defined as being the direction perpendicular to the plane P of the cables 1, 2. Likewise the directions "longitudinal" and "lateral" are defined as being the directions horizontal and parallel to the normal movement in line of the cables 1, 2 and respectively horizontal and perpendicular to the normal movement in line of the cables 1, 2.

The terms "downstream" and "upstream" are used hereunder with reference to the direction of movement of the cables 1,2. The terms "inside cable" and "outside cable" are used hereunder with reference to the loop formed by the car circulation tracks, i.e. by the two loops formed by the cables 1,2.

The invention is described hereunder with reference to one such embarking/disembarking station. It is understood that the characteristics of the invention may advantageously be reproduced in several or all of the end or intermediate embarking/disembarking stations.

Figure 2:
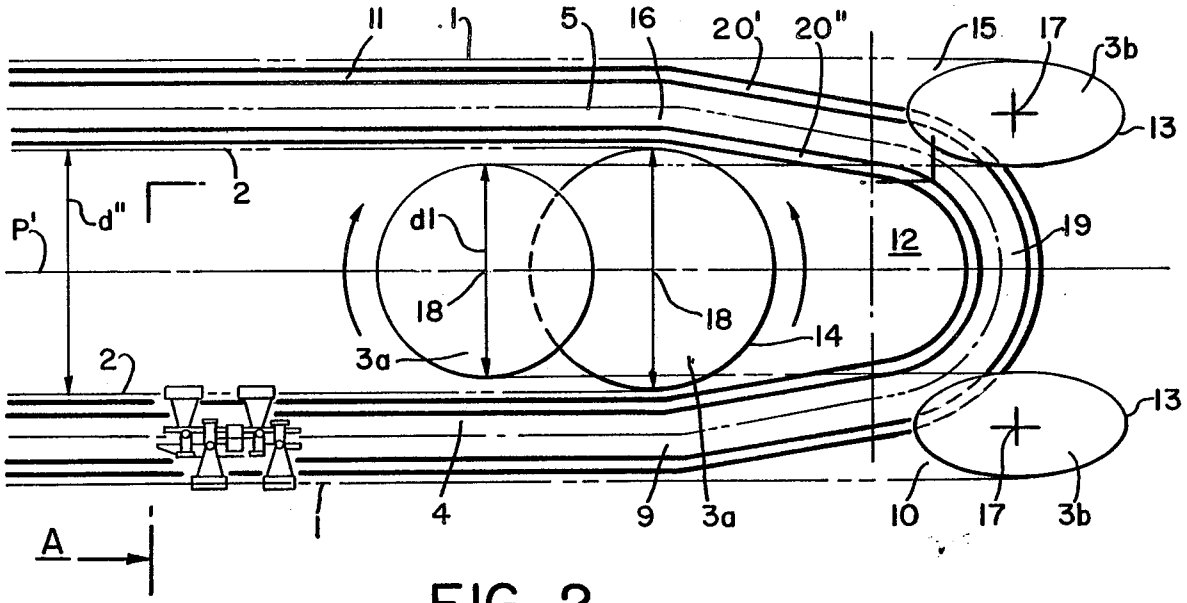
FIG. 2 is a plan view of the station illustrated in FIG. 1.
Figure 3A:
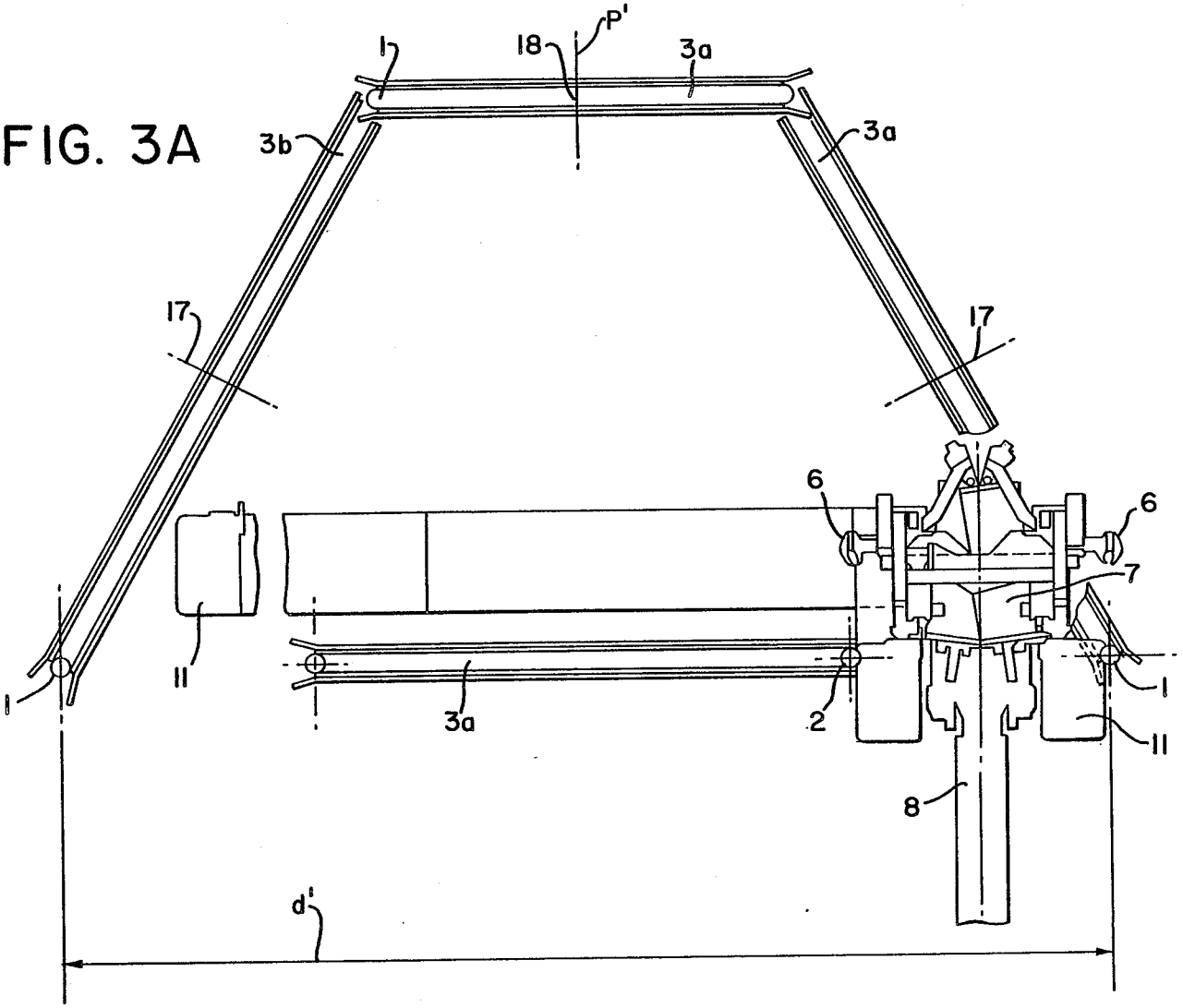
FIG. 3A is an enlarged view illustrating in greater detail the structure depicted in FIG. 3.

A loop formed by one of the cables 1 or 2 comprises at least one end pulley 3*a* known as "return pulley 3*a*", which, as illustrated in FIG. 2, forms the extreme end of the loop for its associated cable 1 or 2 but which is not necessarily the pulley which is the farthest along the longitudinal path of travel of the cable through the station, separates the tracks of arrival 4 and departure 5 of the cable 1 or 2.

According to the invention, at least one return pulley 3*a* of at least one loop formed by a cable 1 or 2; located in the farthest position in relation to this loop and separating the tracks of arrival 4 and departure 5 of the cable 1,2, is substantially parallel to the track of arrival 4 and/or to the track of departure 5, whilst being on a different plane. The installation comprises means 3*b* for guiding the cable 1, 2 towards said means 3*b* for guiding the cable being after "pulley 3*a*", this return pulley 3*a*, arranged upstream of this pulley 3*a*. The installation comprises means 3*b* for guiding the cable 1,2 away from this return pulley 3*a*, said means 3*b* for guiding the cable being arranged downstream of this pulley 3*a*.

At least one return pulley 3*a* of at least one loop formed by a cable 1, 2 is recessed with respect to this loop, towards the inside of the line of circulation of the cars with respect to the farthest pulleys 3*b* vis-a-vis the installation, the means 3*b* of guiding causing a half-turn of the cable 1, 2 upstream and downstream of the return pulley 3*a*. A return pulley 3*a* which forms one end of a loop of cable 1 or 2 in the station is not therefore longitudinally extreme with respect to the station.

At least one return pulley 3*a* of at least one loop formed by a cable 1, 2, located in the farthest position in relation to this loop and separating the tracks of arrival 4 and of departure 5 of the cable 1, 2, has a diameter $d_1$, $d_2$ different from—in particular smaller than—the lateral distance d', d'' separating the track of arrival 4 and the track of departure 5. Preferably the means 3*b* of guiding comprise pulleys 3*b* with axes 17 inclined or horizontal, at least one such pulley 3*b* being provided upstream and downstream of each return pulley 3*a*, the guiding pulleys 3*b* upstream and downstream being arranged symmetrically with respect to one another in relation to the longitudinal plane P' containing the centre 18 of the return pulley 3*a*. The axes 17 of these guiding pulleys 3*b* are inclined in relation to the horizontal plane P so as to guide the cable 1, 2 towards the return pulley 3*a*, the diameter whereof is different from the lateral distance between the guiding pulleys 3*b* upstream and downstream. These two last characteristics combined with the previous one cause the guiding pulleys 3*b* to form the farthest points of a loop of cable 1, 2 in relation to the installation, more specifically in relation to the station.

According to the invention, one may thus locate the tracks of arrival 4 and departure 5 at a distance from one another, almost at will. Moreover the cars may be disengaged/engaged from/with the cables 1, 2 as they approach and laterally pass the guiding pulleys 3*b* without the need to modify their spacing in advance. In the possible (but not illustrated) embodiments wherein each loop of cable 1, 2 conforms with the above characteristics, as the respective guiding pulleys 3*b* of each cable 1, 2 face one another, the incline of the axes 17 of these pulleys 3*b* will be different for one cable 1 and for the other 2, and the trajectory of the means 11 of support/-guiding is deflected vertically such that on laterally passing these guiding pulleys 3*b* the grippers 6 for clamping and the carriage 7 which conveys them are located in a plane situated above the plane P of the cables, to allow the disengagement/engagement of the cars. The means 11 of support/guiding are also deflected horizontally in the tracks of arrival 4 and departure 5, to facilitate the passage of the cars on laterally passing the guiding pulleys 3*b*, in particular towards the inside in relation to the tracks of arrival 4 and departure 5 (moving closer to the plane P').

The axes 17 of the guiding pulleys 3*b*, although inclined, i.e. neither horizontal nor vertical, are substantially perpendicular to the longitudinal direction, and located in a vertical lateral plane.

In the initial embodiments shown (FIGS. 1 to 6), only one loop formed by one of the cables 1 comprises at least one return pulley 3*a* substantially parallel to the track of arrival 4 and/or to the track of departure 5 but in a different plane, the return pulley 3*a* of the other loop formed by the other cable 2 being located at least substantially in the plane P of the tracks of arrival 4 and departure 5.

On the other hand in the third embodiment shown (FIGS. 7 to 9), the two loops formed by the cables 1, 2 each comprise at least one return pulley 3*a* substantially parallel to the track of arrival 4 and/or to the track of departure 5, but in a different plane.

In the three embodiments shown in FIGS. 1 to 9 and preferably, the two loops of cables 1, 2 are of different lengths, imbricated in one another, the two cables 1, 2 not intersecting in an embarking/disembarking station, the outside cable 1 of the track of arrival 4 being also the outside cable 1 of the track of departure 5, the inside cable 2 of the track of arrival 4 also being the inside cable 2 of the track of departure 5. At least the loop which is formed by the outside cable 1 comprises at least one return pulley 3*a* substantially parallel to the track of arrival 4 and/or to the track of departure 5 but in a different plane. At least one return pulley 3*a* of at least one loop formed by a cable 1, 2 is in a plane substantially horizontal, distinct and separate from those (or the one) containing the tracks of arrival 4 and departure 5.

In the embodiments represented in FIGS. 1–9, at least one return pulley 3*a* is above the track of arrival 4 and-/or the track of departure 5.

In a version not represented, at least one return pulley 3*a* is below the track of arrival 4 and/or the track of departure 5.

In the embodiments represented in FIGS. 1–9, the horizontal plane P of the track of arrival 4 and the horizontal plane P of the track of departure 5 are merged or at least close to one another, and the respective return pulleys 3*a* of the loops of the cables 1, 2 are located on the same side in relation to tracks 4, 5, in particular above the plane P. As a variation the return pulleys 3*a* may be located below the plane P of the tracks 4, 5. In another possible version, at least one return pulley 3*a* of a loop formed by a cable 1, 2 is on one side of the tracks 4, 5, whilst at least one return pulley 3*a* of the other loop formed by the other cable 2, 1 is on the other side of the tracks 4, 5, in particular the one being above and the other below the plane P.

In another embodiment, the horizontal plane of the track of arrival 4 and the horizontal plane of the track of departure 5 are distinct and separated vertically from one another. Apart from the possible versions already referred to (the return pulleys 3*a* on the same side or each on one side of the tracks 4, 5) it is also possible in this other embodiment for at least one return pulley 3*a* to be in a substantially horizontal place inserted between the planes of the tracks of arrival 4 and departure 5, for example substantially mid-way between these planes.

In the embodiments represented, and preferably, each loop formed by a cable 1, 2 comprises one return pulley 3*a* and one only. It is however possible to provide two such return pulleys 3*a* per loop, having the same longitudinal position in relation to the tracks of arrival 4 and departure 5, and being separated and facing sideways. It is however preferable to provide only one return pulley 3*a* per loop, in order to be able to bring them close to one other, or to locate them facing one another or to superimpose them, and in this way the better to control the tensioning and driving of the cables 1, 2. On the figures, for greater clarity, the respective return pulleys 3*a* are not shown superimposed or facing one another.

Preferably the return pulley 3*a* of the loop formed by the outside cable 1 is more distanced vertically from the tracks 4, 5 than the return pulley 3*a* of the loop formed by the inside cable 2. On the figures the return pulley 3*a* of the outside cable 1 is in a substantially horizontal plane located above the substantially horizontal plane of the return pulley 3*a* of the inside cable 2.

As already stated, the cars are readily disengaged/engaged from/with the cables 1, 2 on approaching and laterally passing the guiding pulleys 3*b* with inclined axes 17. The means 11 of support/guiding are advantageously deflected, in particular at least laterally, so as to avoid any interference of the cars with these guiding pulleys 3*b*—in particular towards the inside of the tracks 4, 5—and this upstream/downstream of these guiding pulleys 3*b* in the track of arrival 4/in the track of departure 5.

However, for the track of arrival 4 and for the track of departure 5, the zones of cooperation 9, 16, 10, 15 of a cable 1, 2 with the end pulleys 3 in the tracks of arrival 4/departure 5 are displaced longitudinally in relation to the zones of cooperation 10, 15, 9, 16 of the other cable 2, 1 with the end pulleys 3, such that a free space 12 is provided between the respective farthest sections 13, 14 of the loops of cables 1, 2 with respect to the station. The means 11 of support/guiding the cars are deflected—in particular at least laterally—in relation to the normal movement of the cables 1, 2 between these zones of cooperation 9, 16, 10, 15 of the two cables 1, 2.

The zone 9, 16, 10, 15 of cooperation of a cable 1, 2 is the one in which it cooperates away from the track of arrival 4 or towards the track of departure 5 with an end pulley 3, either with a return pulley 3*a* or with a guiding pulley 3*b* towards/away from the return pulley 3*a*. On the track of arrival 4, the means 11 of support/guiding are deflected to move away from the cable 1 the zone 10 of cooperation whereof is downstream, so as to separate the cars of this cable 1. On the track of departure 5, the means 11 of support/guiding are deflected to bring them closer to the cable 1 the zone 15 of cooperation whereof is upstream, so as to move the cars of this cable 1 closer.

In the embodiments represented, the zone 9 of cooperation of the inside cable 2 of the track of arrival 4 is upstream of the zone 10 of cooperation of the outside cable 1 of the track of arrival 4, and the zone 16 of cooperation of the inside cable 2 of the track of departure 5 is downstream of the zone 15 of cooperation of the outside cable 1 of the track of departure 5.

Preferably, in the engaged state, the grippers 6 for clamping bear on the top part of the cables 1, 2. The invention is also applicable in the contrary case where the grippers enclose the cable underneath or at the inside or outside sides, but is of considerably less interest since the problem of the engagement/disengagement of the cars with/from the cables 1, 2 is not as acute.

Likewise the invention is advantageous when a carriage 7 comprises two pairs of grippers 6 for clamping 6, i.e. four grippers connected in pairs with respect to each cable 1, 2. The four grippers generally define a rigid quadrilateral.

According to an important characteristic of the invention, the space between the two cables 1, 2 is kept constant upstream and downstream of the end pulleys 3—in particular upstream of the guiding pulleys 3*b* of the track of arrival 4 and downstream of the guiding pulleys 3*b* of the track of departure 5. This space between the cables 1, 2 may have a classical value. For example, this space is smaller than the lateral clearance of the cars. The invention is moreover also applicable in a contrary case where the distance between the cables 1, 2 is larger than the lateral clearance of the cars, but of less interest since the disengagement and the engagement of the cars may be effected differently. This distance is for example between 0.5 m and 3 m, in particular of the order of 0.75, or of the order of 1.4 m. An installation according to the invention is thus devoid of deflecting rollers of the cables 1, 2 aimed at modifying their distance upstream and downstream of the end pulleys 3—in particular upstream of the guiding pulleys 3*b* of the track of arrival 4 and downstream of the guiding pulleys 3*b* of the track of departure 5. It is also preferably devoid of deflecting rollers of the cables 1, 2 between the end pulleys 3.

As illustrated in FIGS. 1–9, at least in one embarking/disembarking station, and preferably also in line, the tracks 4, 5 of the cables 1, 2 are substantially symmetrical in relation to a longitudinal vertical plane P'. The same applies to the means 3*b* of guiding the cables 1, 2, the means 11 of supporting/guiding the cars. The plane P' contains the centre 18 of the return pulleys 3*a* when a single such pulley 3*a* is provided for each cable 1,2. If a number of return pulleys 3*a* are provided per cable 1, 2, these pulleys are arranged substantially symmetrically in relation to the plane P'.

Figure 3:
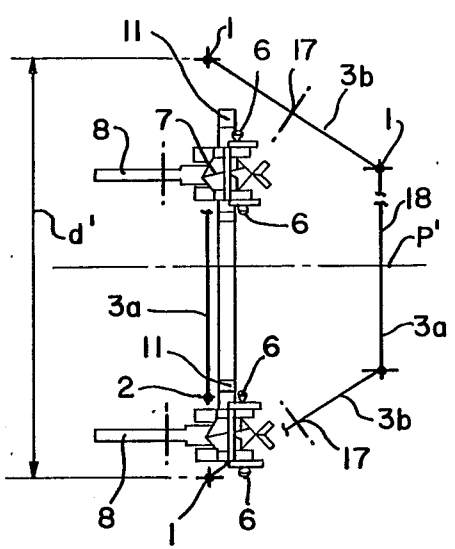
FIG. 3 is a partial schematic sectional view taken along the line A—A of FIG. 2.

In the first embodiment represented in FIGS. 1 to 3, the two loops of cables 1,2 not interconnecting in the embarking/disembarking station. The installation comprises an outside cable 1 and an inside cable 2. The track of arrival 4 is located in the same plane P as the track of departure 5. The return pulley 3*a* of the inside cable 2 is located in said plane P. The loop which is formed by the outside cable 1 has its return pulley 3*a* at least substantially parallel to plane P, but in a different at least substantially horizontal plane. This return pulley 3*a* of the outside cable 1 is above the tracks of arrival 4 and departure 5, and is recessed with respect to the loop formed by the outside cable 1, towards the inside of the line of circulation of the cars. The installation comprises a guiding pulley 3*b* for guiding the outside cable 1 from the track of arrival 4 towards the return pulley 3*a*, and a guiding pulley 3*b* for guiding the outside cable 1 from its return pulley 3*a* towards the track of departure 5. These guiding pulleys are the pulleys which are located in the farthest position in the station with respect to the installation, i.e. are longitudinally extreme with respect to the station.

The zone 9 of cooperation of the inside cable 2 of the track of arrival 4 with its return pulley 3*a* is upstream of the zone 10 of cooperation of the outside cable 1 of the track of arrival 4 with its guiding pulley 3b. The zone 16 of cooperation of the inside cable 2 of the track of departure 5 with its return pulley 3a is downstream of the zone 15 of cooperation of the outside cable 1 of the track of departure 5 with its guiding pulley 3b. Thus, a free space 12 is provided between the respective farthest sections 13, 14 of the loops of cables 1, 2 with respect to the station.

The transfer supporting/guiding rails 11 are laterally deflected in the track of arrival 4, from the zone 9 of cooperation of the inside cable 2 with its return pulley 3a, towards the inside of the tracks 4, 5, so as to avoid any interference of the cars with the guiding pulley 3b of the outside cable 1, and this upstream of the guiding pulley in the track of arrival 4. The same is provided for the track of departure 5, symmetrically with respect to the plane P'.

The space between the two cables 1, 2 is kept constant upstream of the return pulley 3a of the inside cable 2 and downstream of the return pulley 3a of the inside cable 2.

In the first embodiment represented in FIGS. 1 to 3, the outside cable 1 comprises a return pulley 3a located above the plane P of the cables and recessed towards the inside, i.e. towards the line of circulation of the cars. The means 3b of guiding this cable 1 are constituted by two pulleys 3b with axes 17 inclined laterally towards the outside to guide the cable 1 towards the return pulley 3a. These guiding pulleys 3a of the outside cable 1 are at least substantially aligned and facing in the lateral direction, although they are not paralalel, and are they are located at the farthest section of the loop of the outside cable 1 in relation to the installation. The theoretical extensions of the inclined axes 17 converge towards the bottom, substantially on the longitudinal vertical plane P' of symmetry. The diameter $d_1$ of the return pulley 3a is smaller than the distance d' separating the cable 1 on the track of arrival 4 from this same cable 1 on the track of departure. On the other hand the return pulley 3a of the inside cable 2 is in this embodiment arranged in a classical manner in the plane P of the cables 1, 2, is displaced longitudinally and recessed towards the inside in relation to the guiding pulleys 3b, and has a diameter $d_2$ at least substantially equal to the distance d'' separating the inside cable 2 on the track of arrival 4 from this same cable 2 on the track of departure 5. The cable 2 cooperates directly and solely with its return pulley 3a. In this case it is necessary to provide the longitudinal displacement of the zones 9, 15 and 10, 16 respectively of cooperation of the outside cable 1 and inside cable 2 respectively with the end pulleys 3, in order to be able to disengage/engage the cars. The outside cable 1 arrives on the track of arrival 4 and cooperates with a guiding pulley 3b which causes it to make a half-turn and moves it up again to the level of the plane of the return pulley 3a, in alignment with the score of this pulley 3a located on the side of the track of arrival 4. The return pulley 3a causes the outside cable 1 to make a half-turn, which cable then cooperates with another guiding pulley 3b which causes it to make a half-turn to redescend to the level of the plane P of the cables 1, 2 on the track of departure 5.

The first embodiment according to the invention is thus characterised in that, in at least one embarking-/disembarking station, the outside cable 1 comprises a return pulley 3a located above the plane P of the cables 1, 2 forming the tracks 4, 5 of arrival and department defined by the cables 1, 2 and recessed towards the inside of the line of circulation of the cars, guiding pulleys 3b with inclined axes for guiding this outside cable 1 towards and from its return pulley 3a being provided at the farthest section of the loop of the outside cable 1 in relation to the installation, and in that the inside cable 2 comprises a return pulley 3a located in the plan P of the tracks of arrival and departure 4, 5 displaced longitudinally and recessed towards the inside in relation to the guiding pulleys 3b of the outside cable 1, the inside cable 2 cooperating directly and solely with its return pulley 3a.

Figure 4:
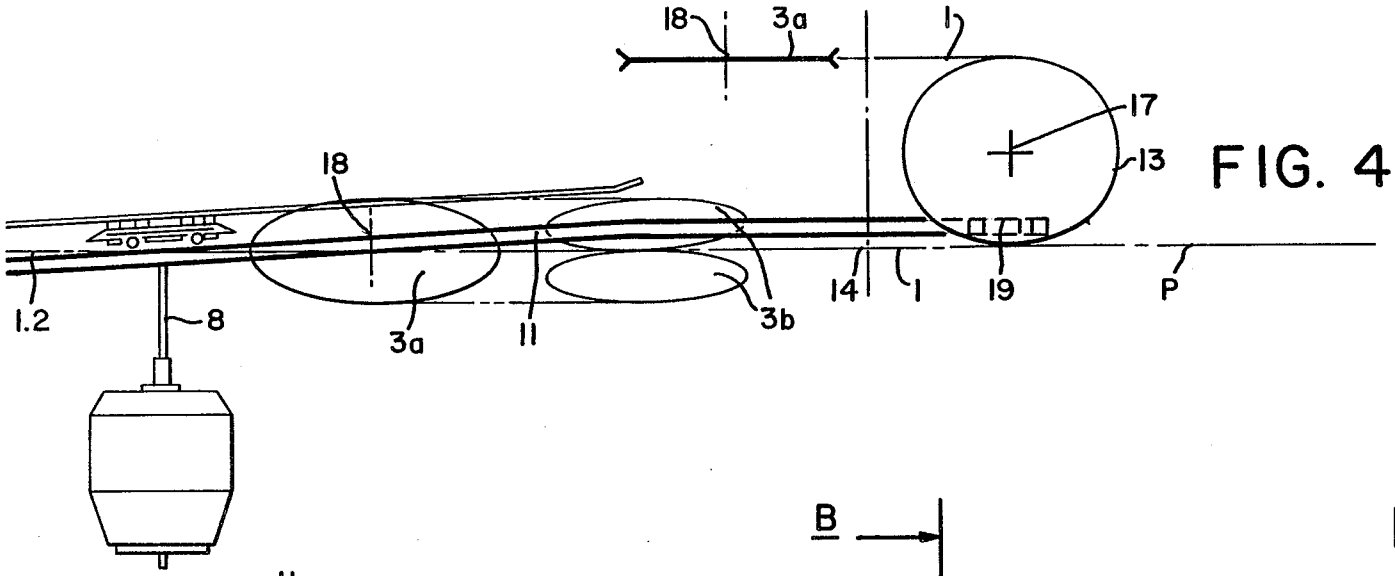
FIG. 4 is a side elevational view of an embarking-/disembarking station according to a second embodiment of the invention.
Figure 6:
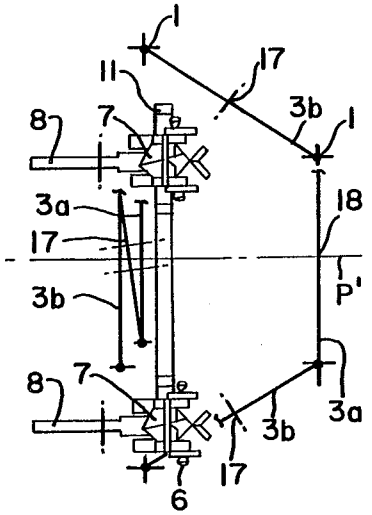
FIG. 6 is a partial schematic sectional view taken along the line B—B of FIG. 5.
Figure 5:
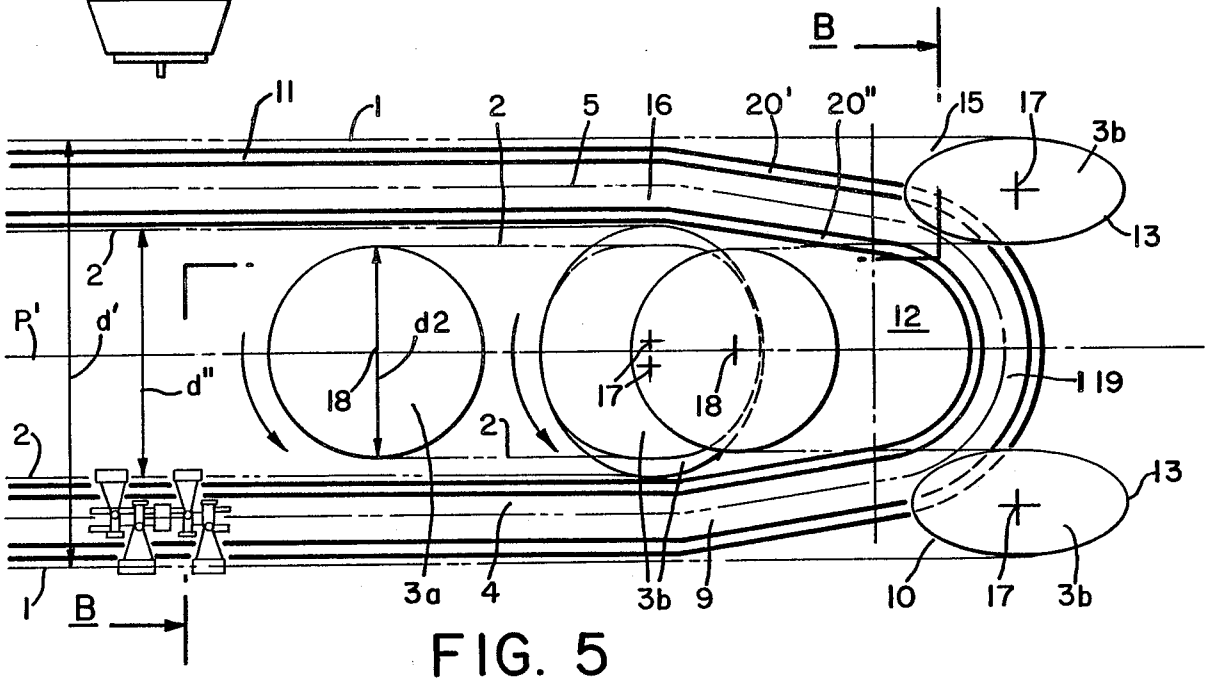
FIG. 5 is a top plan view of the station illustrated in FIG. 4.
Figure 6A:
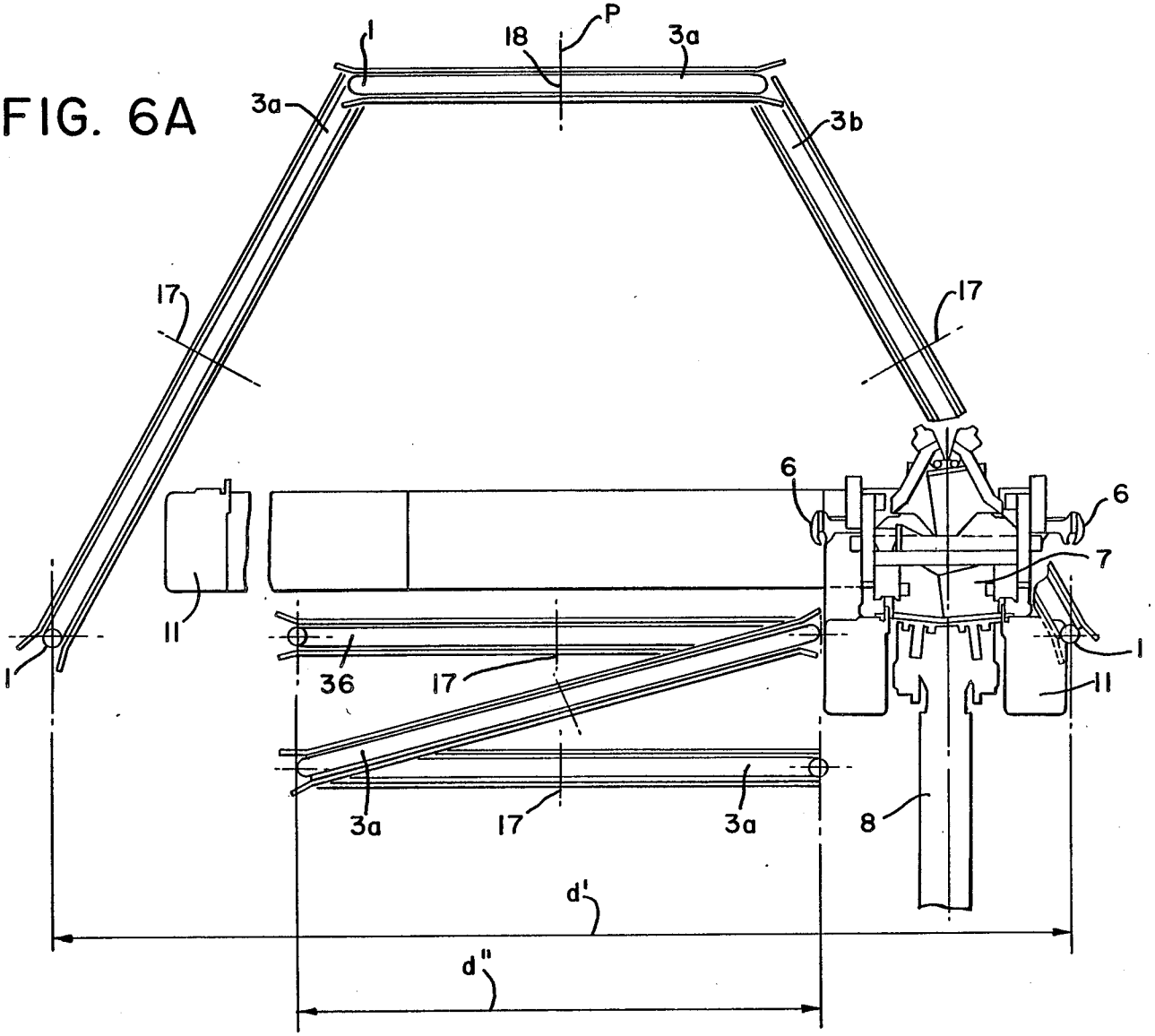
FIG. 6A is an enlarged detailed view illustrating in greater detail the structure depicted in FIG. 6.

In the second embodiment represented in FIGS. 4 to 6, the two loops of cables 1, 2 do not intersect in the embarking/disembarking station. The installation comprises an outside cable 1 and an inside cable 2. The track of arrival 4 is located in the same plane P as the track of departure 5. The return pulley 3a of the inside cable 2 is located substantially in said plane P. The loop which is formed by the outside cable 1 has its return pulley 3a at least substantially parallel to plane P, but in a different at least substantially horizontal plane. This return pulley 3a of the outside cable 1 is above the tracks of arrival 4 and departure 5, and is recessed with respect to the loop formed by the outside cable 1, towards the inside of the line of circulation of the cars. The installation comprises a guiding pulleys 3b for guiding the outside cable 1 from the track of arrival 4 towards its return pulley 3a, and a guiding pulley 3b for guiding the outside cable 1 from its return pulley 3a towards the track of departure 5. The installation also comprises a guiding pulley 3b for guiding the inside cable 2 from the track of arrival 4 towards its return pulley 3a which is also recessed with respect to the loop formed by the inside cable 2, towards the inside of the line of circulation of the cars. Another guiding pulley 3b is provided for guiding the inside cable 2 from its return pulley 3a towards the track of departure 5.

The guiding pulleys 3b of the outside cable 1 are the pulleys which are located in the farthest position in the station with respect to the installation, i.e. are longitudinally extreme with respect to the station.

The zone 9 of cooperation of the inside cable 2 of the track of arrival 4 with its guiding pulley 3b is upstream of the zone 10 of cooperation of the outside cable 1 of the track of arrival 4 with its guiding pulley 3b. The zone 16 of cooperation of the inside cable 2 of the track of departure 5 with its guiding pulley 3b is downstream of the zone 15 of cooperation of the outside cable 1 of the track of departure 5 with its guiding pulley 3b. Thus, a free space 12 is provided between the respective farthest sections 13, 14 of the loops of cables 1, 2 with respect to the station.

The transfer supporting/guiding rails 11 are laterally deflected in the track of arrival 4, from the zone 9 of cooperation of the inside cable 2 with its guiding pulley 3b, towards the inside of the tracks 4, 5, so as to avoid any interference of the cars with the guiding pulley 3b of the outside cable 1, and this upstream of the guiding pulley 3b of the outside cable 1 in the track of arrival 4. The same is provided for the track of departure 5, symmetrically with respect to the plane P'.

The space between the two cables 1, 2 is kept constant upstream of the guiding pulley 3b of the inside cable 2 of the track of arrival 4 and downstream of the guiding pulley 3b of the inside cable 2 of the track of departure 5.

In the second embodiment represented in FIGS. 4 to 6, the movement of the external cable 1 is substantially the same as in the first embodiment. On the other hand the return pulley 3a of the inside cable 2 has a diameter $d_2$ smaller than the distance d'' separating the tracks of arrival and departure 5 of the inside cable 2, and is set back towards the inside of the line of circulation of the cars, but substantially in the plane P of the cables 1,2. Two pulleys 3b guiding this cable 2, of a diameter substantially equal to $$\frac{d_2 + d''}{2}$$

guide respectively this cable 2 towards and the return pulley 3a away from and towards its normal movement on the track of arrival 4 and departure 5.

These pulleys 3b are displaced laterally substantially by $$\frac{d'' - d_2}{2}$$

in relation to one another. They are also both displaced longitudinally and recessed towards the inside of the line in relation to the guiding pulleys 3b of the outside cable 1, so that the zones 9, 16, 10, 15 of cooperation of the cables 1, 2 are displaced longitudinally and a free space 12 of disengagement/engagement of cars is provided between these guiding pulleys 3b of the cable 1 and those of cable 2. The guiding pulleys 3b of the inside cable 2 are shifted longitudinally from the return pulley 3a, being further away than this return pulley 3a in relation to the station.

On the FIGS. 4 to 6, the guiding pulleys 3b and return pulleys 3a of the inside cable 2 are substantially horizontal but slightly inclined, to allow the passage of the cable 2. The two guiding pulleys 3b are superimposed. They may also in a variation not shown be displaced longitudinally in relation to one another.

The inside cable 2 cooperates from the track of arrival 4 with a guiding pulley 3b which causes it to make a half-turn to align it with the score of the return pulley 3a which is located on the opposite side, i.e. towards the track of departure 5. The pulley 3a has caused the inside cable 2 to make a half-turn, which cable returns from the side and close to the track of arrival 4 and then cooperates with the other guiding pulley 3b which causes it to make a half-turn when bringing it onto the track of departure 5.

The second embodiment according to the invention is thus characterized in that, in at least one embarking-/disembarking station, the outside cable 1 comprises a return pulley 3a located above the plan P of the cables 1, 2 forming the tracks of arrival and departure 4, 5 defined by the cables 1, 2 and recessed towards the inside of the line of circulation of the cars, guiding pulleys 3b with inclined axes for guiding this outside cable 1 towards and from its return pulley 3a being provided at the farthest section of the loop of the outside cable 1 in relation to the installation, in that the inside cable 2 comprises a return pulley 3a recessed towards the inside of the line of circulation of the cars but substantially in the plane P of the cables 1, 2 forming the tracks of arrival and departure 4, 5 guiding pulleys 3b with slightly inclined or vertical axes being provided at the farthest section of the loop of the inside cable 2 in relation to the installation to guide this inside cable 2 towards and from its return pulley 3a, and in that the pulleys 3b for guiding the inside cable 2 are displaced longitudinally and recessed towards the inside in relation to the guiding pulleys 3b of the outside cable 1.

Figure 7:
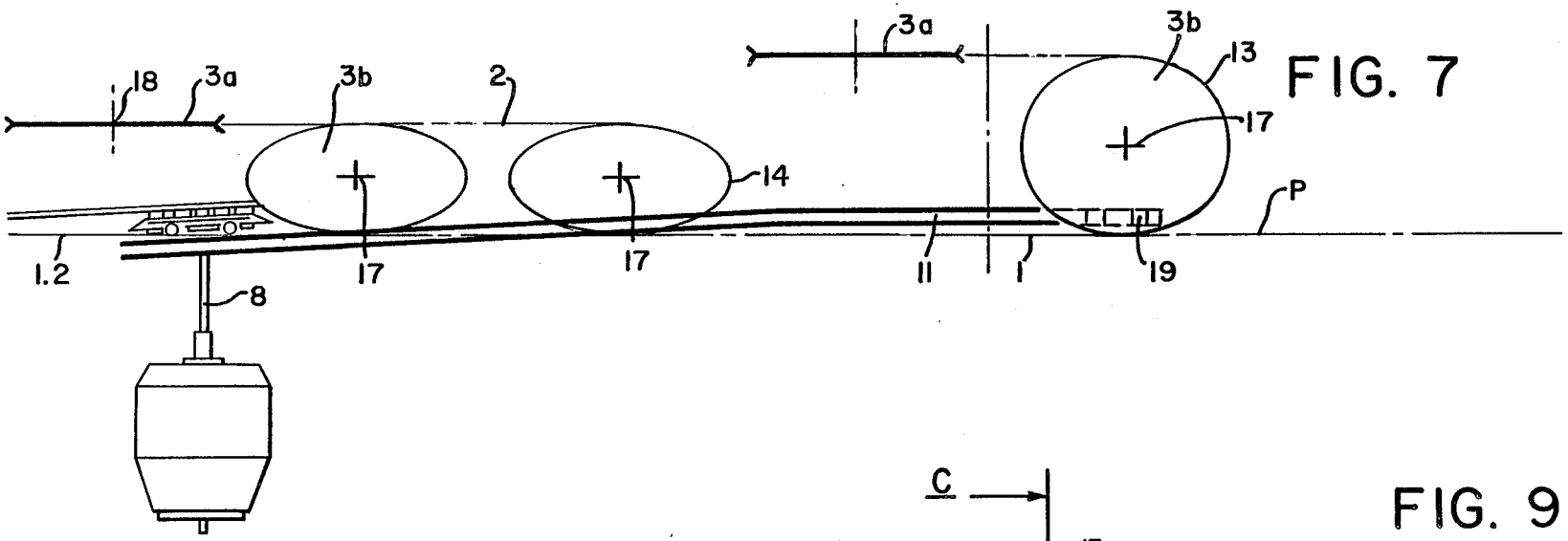
FIG. 7 is a side elevational view of an embarking-/disembarking station according to a third embodiment of the present invention.
Figure 9:
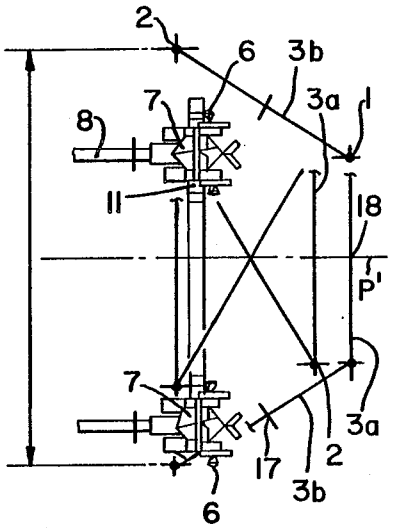
FIG. 9 is a partial sectional view taken along the line C—C of FIG. 8.
Figure 8:
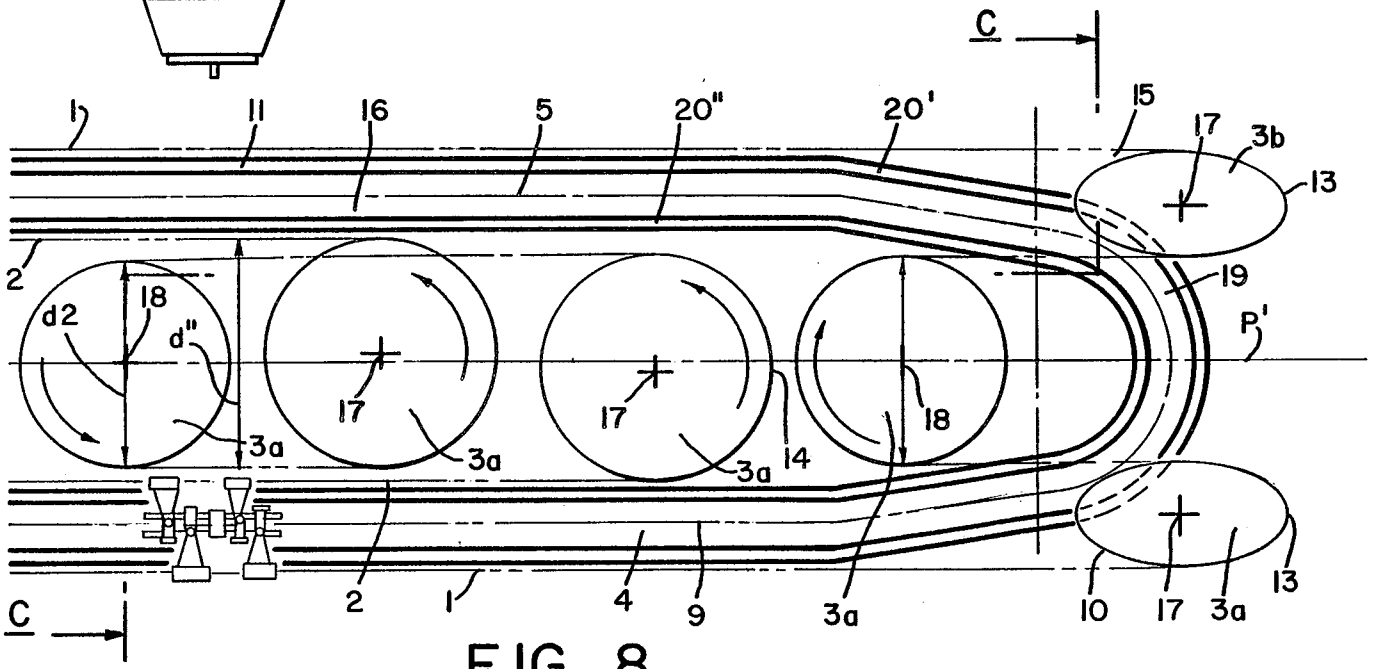
FIG. 8 is a plan view of the station illustrated in FIG. 7.
Figure 9A:
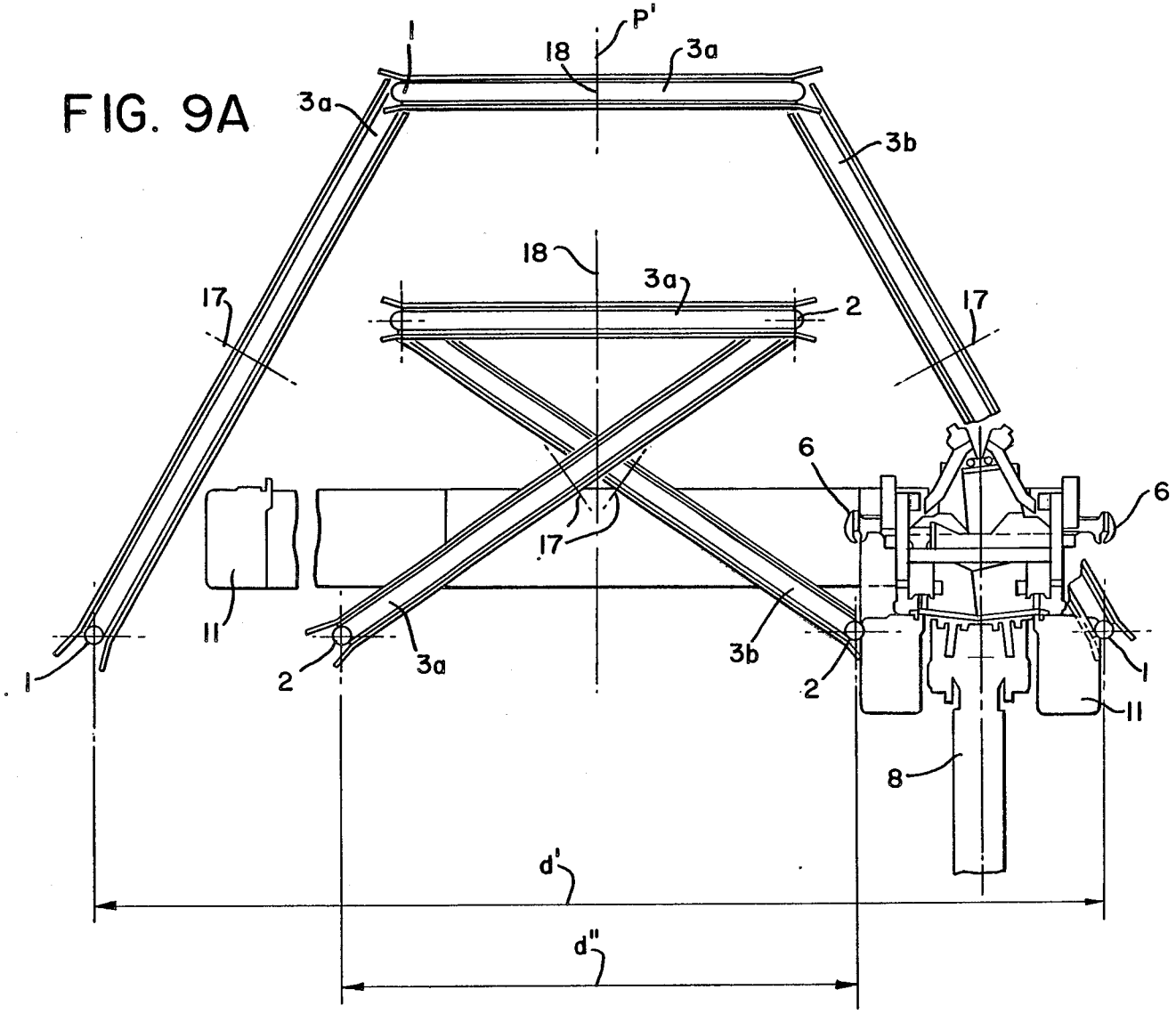
FIG. 9A is an enlarged detailed view similar to FIG. 9.

In the third embodiment represented in FIGS. 7 to 9, the two loops of cables 1, 2 do not interest in the embarking/disembarking station. The installation comprises an outside cable 1 and an inside cable 2. The track of arrival 4 is located in the same plane P as the track of departure 5. The loop which is formed by the inside cable 2 has its return pulley 3a at least substantially horizontal plane. This return pulley 3a of the inside cable 2 is above the tracks of arrival 4 and departure 5, and is recessed with respect to the loop formed by the inside cable 2, towards the inside of the line of circulation of the cars. The loop which is formed by the outside cable 1 has its return pulley 3a at least substantially parallel to plane P, but in a different at least substantially horizontal plane. This return pulley 3a of the outside cable 1 is above the tracks of arrival 4 and 5, and is recessed with respect to the loop formed by the outside cable 1, towards the inside of the line of circulation of the cars. The installation comprises a guiding pulley 3b for guiding the outside cable 1 from the track of arrival 4 towards its return pulley 3a, and a guiding pulley 3b for guiding the outside cable 1 from its return pulley 3a towards the track of departure 5. The installation also comprises a guiding pulley 3b for guiding the inside cable 2 from the track of arrival 4 towards the return pulley 3a of the inside cable 2. Another guiding pulley 3b is providing for guiding the inside cable 2 from its return pulley 3a towards the track of departure 5.

The guiding pulleys 3b of the outside cable 1 are the pulleys which are located in the farthest position in the station with respect to the installation, i.e. are longitudinally extreme with respect to the station.

The zone 9 of cooperation of the inside cable 2 of the track of arrival 4 with its guiding pulley 3b is upstream of the zone 10 of cooperation of the outside cable 1 of the track of arrival 4 with its guiding pulley 3b. The zone 16 of cooperation of the inside cable 2 of the track of departure 5 with its guiding pulley 3b is downstream of the zone 15 of cooperation of the outside cable 1 of the track of departure 5 with its guiding pulley 3b. Thus, a free space 12 is provided between the respective farthest sections 13, 14 of the loops of cables 1, 2 with respect to the station.

The transfer supporting/guiding rails 11 are laterally deflected in the track of arrival 4, from the zone 9 of cooperation of the inside cable 2 with its guiding pulley 3b, towards the inside of the tracks 4, 5, so as to avoid any interference of the cars with the guiding pulley 3b of the outside cable 1, and this upstream of the guiding pulley 3b of the outside cable 1 in the track of arrival 4. The same is provided for the track of departure 5, symmetrically with respect to the plane P'.

The space between the two cables 1, 2 is kept constant upstream of the guiding pulley 3b of the inside cable 2 of the track of arrival 4 and downstream of the guiding pulley 3b of the inside cable 2 of the track of departure 5.

In the third embodiment represented in FIGS. 7 to 9, the movement of the outside cable 1 is substantially the same as in the two previous embodiments. The return pulley 3a of the inside cable 2 is at least substantially horizontal and located above the plane P of the cables 1, 2, but below the return pulley 3*a* of the outside cable 1. The two guiding pulleys 3*b* of the inside cable 2 have axes 17 which are inclined and not parallel, to guide the cable 2 towards the return pulley 3*a*, and can no longer be superimposed as formerly, but are displaced longitudinally in relation to one another. The movement of the inside cable 2 is equivalent to that of the second embodiment, apart from the longitudinal displacement and the incline of the guiding pulleys 3*b*. The diameter d of the return pulley 3*a* of the inside cable 2 is smaller than the distance d" separating the inside cable 2 on the track of arrival 4 and the inside cable 2 on the track of departure 5. The guiding pulleys 3*b* of the inside cable 2 are recessed towards the inside of the line in relation to the guiding pulleys 3*b* of the outside cable 1, to provide a free space 12 facilitating the disengagement and engagement of the cars. On the figures, the guiding pulley 3*b* of the inside cable 2 which is the farthest with respect to the installation is the one cooperating with the track of arrival 4 of the cable 2. It is however possible to provide the reverse, the farthest guiding pulley 3*b* of the inside cable 2 being the one which cooperates with the track of departure 5. The guiding pulleys 3*b* of the inside cable 2 are displaced longitudinally and recessed towards the inside with respect to the guiding pulleys 3*b* of the outside cable 1.

The third embodiment according to the invention is thus characterized in that in at least one embarking-/disembarking station the outside cable 1 comprises a return pulley 3*a* located above the plane P of the cables 1, 2 forming the tracks of arrival and departure 4, 5 defined by the cables 1, 2 and recessed towards the inside of the line of circulation of the cars, guiding pulleys 3*b* with inclined axes for guiding this outside cable 1 towards and from its return pulley 3*a* being provided at the farthest section of the loop of the outside cable 1 in relation to the installation, in that the inside cable 2 comprises a return pulley 3*a* recessed towards the inside of the line of circulation of the cars above the plane P of the cables 1, 2 forming the tracks of arrival and departure 4, 5, guiding pulleys 3*b* with inclined axes being provided at the farthest section of the loop of the inside cable 2 in relation to the installation to guide this inside cable 2 towards and from its return pulley 3*a*, and in that the pulleys 3*b* for guiding the inside cable 2 are displaced longitudinally and recessed towards the inside in relations to the guiding pulleys 3*b* of the outside cable 1.

In the three embodiments represented in FIGS. 1–9, it will be possible to superimpose and render coaxial the respective return pulleys 3*a* of the outside cable 1 and of the inside cable 2. The guiding pulleys 3*b* of the outside cable 1 define the sections 13 of movement of the cables 1, 2 which are the farthest with respect to the station. Each return pulley 3*a* or guiding pulley 3*b* may be replaced by any equivalent element or plurality of elements, in particular by two pulleys displaced laterally if there should prove to be a need.

The means of supporting/guiding are constituted by transfer rails 11 which cooperate with the wheels of the carriage and/or of the car. These transfer rails 11 proceed at least on the right transversely of the end pulley 3 which is the nearest with respect to the loops of cables 1, 2, so as to allow coupling/uncoupling of the cars with the cables 1, 2. The uncoupling phase comprises a stage of disconnection of the grippers of corresponding cables 1, 2 by opening the jaws, then a stage of disengaging the grippers from the cables 1, 2 by relative deflection towards the top of the carriage conveying the grippers in relation to the cables 1, 2. To achieve this the transfer rails 11 have a trajectory in the track of arrival 4 which rises in relation to the plane P of the cables 1, 2 (FIGS. 1, 4, 7).

Likewise, the coupling phase comprises a stage of engaging and a stage of disengaging the grippers in the cables 1, 2 by relative deflection towards the bottom of the carriage 7 in relation to the cables 1, 2, the transfer rails 11 in the track of departure 5 being deflected downwards relative to the plane P of the cables 1, 2 (FIGS. 1, 4, 7).

In an installation according to the invention, these transfer rails 11 may be caused to intersect the vertical plane containing the outside cable 1 by passing below or above, but do not intersect the path of the internal cable 2, i.e. do not pass either above or below.

In the embodiments represented, the transfer rails 11 define a half-turn 19, converging again to allow a car to pass directly from the track of arrival 4 to the track of departure 5, embarking/disembarking goods or persons. In a variation or combination, the transfer rails 11 comprise transfer tracks (not shown) in the direction of the outside, i.e. in the direction of the garage tracks or other sections. These transfer tracks may intersect the vertical plane of the outside cable 1. When passing above, the height between the rails 11 and the cable 2 should be sufficient to allow the passage of the car suspended from the rails 11 above the outside cable 1. The transfer rails 11 may pass between the two guiding pulleys 3*b* and not intersect the vertical planes of the cables 1, 2. The half-turn may be made in the free space 12 between the pulleys 3, or on the other hand at the outside, beyond the farthest pulleys 3*b* with respect to the station. In order to execute the half-turn, the transfer rails 11 may for example describe a circular arc, or any other curve of a particular shape.

The transfer rails of the track of arrival 4 and the transfer rails of the track of departure 5 leading to garage tracks may be closed up again subsequently, for example to combine to form a single garage track or to pass round the pulleys 3. Moreover, each transfer rail 11 is advantageously consituted by two ramps 20', 20", substantially parallel to the constant distance cooperating with the respective rollers of the carriages 7 of the cars, in a manner known per se.

An installation according to the invention preferably comprises two embarking/disembarking stations, at each end of the circulation tracks of the cars. These stations are identical, or executed according to two distinct embodiments. An installation according to the invention may however comprise intermediate embarking/disembarking stations as described above. In this case the circulation tracks may be deflected 90 towards the outside to instal the end pulleys 3, the local direction of the tracks of arrival 4 and departure 5 being perpendicular to the general direction of the line of circulation of the cars between the end stations.

Any variation made up of a combination of characteristics taken from each of the embodiments given by way of a non-restrictive example is possible and obvious to the person having ordinary skill in the art. For example, each element described—in particular each pulley 3—may be replaced by any equivalent means. Moreover the invention is applicable in a general manner to any installation with two suspension-traction cables other than those referred to above, in particular for cars other than those described above by way of example, and or transporting persons or materials. The person having ordinary skill in the art will also be able to adapt the preceding description and the invention to the case of loops of cables 1, 2 not imbricated, and intersecting in an embarking/disembarking station, and/or in order to execute the movements of the two similar cables 1, 2.

What is claimed:

1. An aerial transport installation comprising two parallel, continuously moving suspension-traction cables forming respectively two endless loops, passing over end pulleys respectively located in embarking and disembarking stations; at least one car including disconnectable grippers for clamping the cables, said grippers when connected to the cable bearing on the top part of the cables; said cables cooperating to define a track of circulation for said car in the installation including a track portion of arrival of the car at a station and a track portion of departure of the car from a station, said cables further defining a "horizontal" track plane of arrival and a "horizontal" track plane of departure, each containing both cables, said endless loops defined by each cable having loop portions which are located at the longitudinally furthest points on their paths of travel of the cables through the station, and said end pulleys including at least one return pulley associated with one of the cables which defines the end of its associated cable's loop and is spaced from said longitudinally furthest point on that cable's path of travel through the station and separates said arrival and departure track portions, means for disconnecting and connecting the grippers to the cables and means for supporting and guiding the car located in the embarking and disembarking stations, such that the car is engaged between, driven and conveyed by the cables and that in the embarking and disembarking stations the car is totally disengaged and dissociated from the cables whereby in at least one of the embarking and disembarking stations, for the track portion of arrival and for the track portion of departure defined by the cables, respective zones of cooperation of one of the cables with the end pulleys in the track portions of arrival and departure are displaced longitudinally in relation to the zones of cooperation of the other cable with the end pulleys such that a longitudinal free space is provided between the respective longitudinally farthest sections of the loops of the cables in relation to the station; at least one return pulley of at least one loop formed by a cable being recessed towards the inside of the track of circulation of the car, guiding means for causing the cable to make a half-turn upstream and downstream of the return pulley, and at least one of said return pulleys of at least one loop formed by a cable being substantially parallel to the track portions of arrival and of departure whilst being in a different plane from at least one of said track portions.

2. An installation according to Claim 1, wherein each cable loop comprises for each station one return pulley and one only, the two return pulleys being displaced vertically in relation to one another, and arranged one above the other.

3. An installation according to Claim 1, wherein at least one return pulley of at least one loop formed by one of said cables has a diameter ($d_1$, $d_2$) different from the distance (d', d'') separating the track portion of arrival and the track portion of departure.

4. An installation according to Claim 1, wherein the guiding means includes a plurality of pulleys being located upstream and one downstream of each return pulley in the direction of travel of the cable, the guiding pulleys upstream and downstream being arranged symmetrically to one another in relation to the longitudinal plane P' containing the centre of the return pulley.

5. An installation according to Claim 1, wherein the two loops of cable are of different lengths, imbricated with one another, and do not intersect in said embarking and disembarking stations, said cables respectively defining inside and outside cables, the cable that is outside in the track portion of arrival being also the outside cable of the track portion of departure; at least the loop formed by the outside cable comprising at least one return pulley substantially parallel to the track portion of arrival and to the track portion of departure, but in a different plane.

6. An installation according to Claim 1, wherein only one loop formed by one of the cables includes at least one return pulley substantially parallel to the track portion of arrival and to the track portion of departure but in a different plane, the return pulley of the other loop formed by the other cable being located at least substantially in a plane P defined by the track portions of arrival and departure.

7. An installation according to Claim 1, wherein the two loops formed by the cables each include at least one return pulley substantially parallel to the track portion of arrival and to the track portion of departure but in a different plane.

8. An installation according to Claim 1, characterised in that at least one return pulley of at least one loop of cable is in a substantially horizontal plane, distinct from the planes of the track portions of arrival and departure.

9. An installation according to Claim 8, wherein at least one return pulley is above the track portions of arrival and departure.

10. An installation according to Claim 7, wherein the means for supporting and guiding the car are deflected at least laterally in relation to the path normally taken by the cables between the zones of cooperation of the cables with the end pulleys, said means for supporting and guiding being deflected to move away from the cable on the track portion of arrival to separate the car from the cable and being deflected to move closer to the cable in the zone of cooperation in the track portion of departure so as to move the car towards the cable.

11. An installation according to Claim 7, wherein the two loops of cable are of different lengths, imbricated in one another, and not intersecting in the embarking and disembarking stations, the cable that is on the outside of the track portion of arrival also being on the outside of the track of departure, the zone of cooperation of the inside cable of the track portion of arrival being upstream of the zone of cooperation of the outside cable of the track portion of arrival, and the zone of cooperation of the inside cable of the track portion of departure being downstream of the zone of cooperation of the outside cable of the track portion of departure.

12. An installation according to Claim 1, wherein said car includes a carriage having two pairs of grippers for clamping the cables.

13. An installation according to Claim 1, wherein the space between the two cables is kept constant upstream and downstream of the end pulleys.

14. An installation according to Claim 1, wherein no rollers are provided for deflecting the cables and changing their spacing upstream and downstream of the end pulleys.

15. An installation according to Claim 1, wherein no rollers are provided for deflecting the cables between the end pulleys.

16. An aerial transport installation comprising two parallel, continuously moving suspension-traction cables forming respectively two endless loops passing over end pulleys located in embarking and disembarking stations; at least one car equipped with disconnectable grippers for clamping on the top part of the cables, said cables defining a line of circulation of the car where the car is connected to the cables, and, in each station, a track of arrival for the car and a track of departure for the car, the cables defining a horizontal plane P of the tracks of arrival and of departure, and the loops of cables defining respective farthest sections in relation to the station, said end pulleys including at least one return pulley which is extreme with respect to the corresponding loop of cable and separates the track of arrival and the track of departure means for disconnecting and connecting the grippers and means for supporting and guiding the cars located in the embarking and disembarking stations, such that in line the cars are engaged between, driven and conveyed by the cables and that in the embarking and disembarking stations the cars are totally disengaged and dissociated from the cables, the two cable loops being imbricated in one another and defining an outside cable and an inside cable, wherein in at least one embarking and disembarking station a return pulley is provided for the outside cable which is located above the plane P of the cables forming the tracks of arrival and departure defined by the cables and recessed towards the inside of the line of circulation of the cars, guiding pulleys with inclined axes for guiding this outside cable towards and from its return pulley being provided at the farthest section of the loop of the outside cable in relation to the installation, and wherein another return pulley is provided for the inside cable which is located in the plane P of the tracks of arrival and departure, said another return pulley being displaced longitudinally and recessed towards the inside in relation to the guiding pulleys of the outside cable, the inside cable cooperating directly and solely with its return pulley.

17. An aerial transport installation comprising two parallel, continuously moving suspension-traction cables forming respectively two endless loops, passing over end pulleys located in embarking and disembarking stations; at least one car equipped with disconnectable grippers for clamping on the top part of the cables, said cables defining a line of circulation of the car where the car is connected to the cables, and, in each station, a track of arrival for the car and a track of departure for the car, the cables defining a horizontal plane P of the tracks of arrival and of departure, and the loops of cables defining respective farthest sections in relation to the station, said end pulleys including at least one return pulley which is extreme with respect of the corresponding loop of cable and which separates the track of arrival and the track of departure; means for disconnecting and connecting the grippers and means for supporting and guiding the cars located in the embarking and disembarking stations, such that the car is engaged between, driven and conveyed by the cables and that in the embarking and disembarking stations the car is totally disengaged and dissociated from the cables, the two cables forming an outside cable and an inside cable in the tracks of arrival and departure, wherein at least one of said embarking and disembarking stations includes a return pulley for the outside cable located above the plane P of the cables forming the tracks of arrival and departure defined by the cables and recessed towards the inside of the line of circulation of the cars, guiding pulleys with inclined axes for guiding this outside cable towards and from its return pulley being provided at the farthest section of the loop of the outside cable in relation to the installation, and another return pulley, for the inside cable, recessed towards the inside of the line of circulation of the car but substantially in the plane P of the cables forming the tracks of arrival and departure, guiding pulleys with slightly inclined or vertical axes being provided at the farthest section of the loop of the inside cable in relation to the installation to guide this inside cable towards its return pulley and wherein the pulleys for guiding the inside cable are displaced longitudinally and recessed towards the inside in relation to the guiding pulleys of the outside cable.

18. An aerial transport installation comprising two parallel, continuously moving suspension-traction cables forming respectively two endless loops, passing over end pulleys located in embarking and disembarking stations; at least one car equipped with disconnectable grippers for clamping on the top part of the cables, said cables defining a line of circulation of the car where the car is connected to the cables, and, in each station, a track of arrival for the car and a track of departure for the car, the cables defining a horizontal plane P of the tracks of arrival and of departure, and the loops of cables defining respective farthest sections in relation to the station, said end pulleys including at least one return pulley which is extreme with respect of the corresponding loop of cable and which separates the track of arrival and the track of departure; means for disconnecting and connecting the grippers and means for supporting and guiding the cars located in the embarking and disembarking stations, such that the car is engaged between, driven and conveyed by the cables and that in the embarking and disembarking stations the car is totally disengaged and dissociated from the cables, the two cables forming an outside cable and an inside cable in the tracks of arrival and departure, wherein at least one of said embarking and disembarking stations includes a return pulley for the outside cable located above the plane P of the cables forming the tracks of arrival and departure defined by the cables and recessed towards the inside of the line of circulation of the cars, guiding pulleys with inclined axes for guiding this outside cable towards and from its return pulley being provided at the farthest section of the loop of the outside cable in relation to the installation, and another return pulley, for the inside cable, recessed towards the inside of the line of circulation of the car above the plane P of the cables forming the tracks of arrival and departure, guiding pulleys with inclined axes being provided at the farthest section of the loop of the inside cable in relation to the installation to guide this inside cable towards and from its return pulley, and wherein the pulleys for guiding the inside cable are displaced longitudinally and recessed towards the inside in relation to the guiding pulleys of the outside cable.

19. An installation according to Claim 3, wherein at least one return pulley of at least one loop of cable has a diameter ($d_1$, $d_2$) smaller than the distance ($d'$, $d''$) separating the track of arrival and the track of departure.

* * * * *